US007509033B2

(12) United States Patent
Jackson

(10) Patent No.: US 7,509,033 B2
(45) Date of Patent: Mar. 24, 2009

(54) SIDE PORT INSERT DESIGN FOR WATER HEATER

(75) Inventor: Barry N. Jackson, Woodbury, MN (US)

(73) Assignee: Rheem Manufacturing Company, Atlanta, GA (US)

( * ) Notice: Subject to any disclaimer, the term of this patent is extended or adjusted under 35 U.S.C. 154(b) by 301 days.

(21) Appl. No.: 11/611,248

(22) Filed: Dec. 15, 2006

(65) Prior Publication Data

US 2008/0145039 A1 Jun. 19, 2008

(51) Int. Cl.
*F24D 19/02* (2006.01)

(52) U.S. Cl. ..... 392/339; 392/455

(58) Field of Classification Search ..... 392/339, 392/455

See application file for complete search history.

(56) References Cited

U.S. PATENT DOCUMENTS 2,784,291 A * 3/1957 Harney ..... 392/452
3,546,429 A * 12/1970 DeJersey et al. ..... 392/452
4,687,905 A 8/1987 Cunningham et al.
4,735,511 A 4/1988 Gauer et al.
5,220,638 A 6/1993 Moore et al.
5,386,100 A 1/1995 McNair
5,878,192 A * 3/1999 Jackson ..... 392/452
6,064,801 A 5/2000 Stokes et al.
6,256,456 B1 7/2001 DeSantis
6,266,485 B1 7/2001 DeSantis et al.
6,370,328 B1 4/2002 Mottershead

* cited by examiner

*Primary Examiner*—Thor S Campbell
(74) *Attorney, Agent, or Firm*—Haynes and Boone, LLP

(57) ABSTRACT

An electric water heater has a tubular side port insert, projecting into the interior of the filament-wound plastic tank portion of the water heater tank, operative to conduct tank water heat to an external temperature controller. The insert has a tubular base extending through the tank wall and circumscribing a cold pin portion of an electrical resistance type heating element extending into the tank, and a hood portion forming a horizontally inward extension of the insert base and extending along only a top side portion of the element in an upwardly spaced relationship therewith so that no portion of the insert extends beneath the active portion of the heating element. In this manner, scale forming on the active portion of the element, and falling therefrom, does not become trapped between the heating element and the side port insert, and overshoot of the controlled tank water temperature is substantially reduced.

24 Claims, 2 Drawing Sheets

SIDE PORT INSERT DESIGN FOR WATER HEATER

BACKGROUND OF THE INVENTION

The present invention generally relates to liquid heating apparatus and, in a representatively illustrated embodiment thereof, more particularly relates to a specially designed temperature sensing side port insert for an electric water heater.

In electric water heaters having non-metallic tanks, such as plastic tanks reinforced by external, resin-impregnated filament winding, a design challenge is presented in sensing the temperature of heated water in the tank portion of the water heater for water temperature control purposes. Sensing the water temperature by simply sensing the outer side surface temperature of the tank is not a practical option due to the thermal insulating characteristics of the plastic/filament winding construction of the tank walls.

Previous alternative proposals have entailed the sealed insertion through the tank wall of a tubular metal port member through which an electric heating element extended into the tank interior, the heating element being appropriately sealed within the port member. Heat from the stored tank water was conductively transferred outwardly through the port member to an externally disposed thermostat used to appropriately activate and de-energize the heating element in response to sensed tank water temperature.

This proposed approach to sensing internal tank water temperature presented two primary problems. Depending on the configuration of the port member, it could cause an undesirable degree of temperature sensing lag, and a corresponding amount of water-set point temperature overshoot, or could alternatively cause a scale build-up between the electrical heating element and the port member which substantially shortened the operational life of the heating element. A need thus exists for an improved port member design which eliminates or at least substantially reduces these problems.

SUMMARY OF THE INVENTION

In carrying out principles of the present invention, in accordance with a representatively illustrated embodiment thereof, a specially designed side port insert member is provided for use with a liquid heating appliance which is illustratively, but not by way of limitation, an electric water heater having a heated liquid storage tank with an opening in a vertical side wall thereof. The side port insert member is formed from a highly thermally conductive material, such as a suitable metal, and is incorporated in a temperature sensing system used to externally sense the heated water temperature within the tank which is representatively of a filament wound plastic construction. The liquid heating appliance is also provided with a heating system for controllably heating the liquid within the tank, the heating system illustratively including an elongated electric heating structure having, sequentially along its length, an outer end portion, an inactive heating element section, and an active heating element section.

The side port insert member, in a representatively illustrated embodiment thereof, has a tubular base that circumscribes an axis, has an upper side portion, and is configured to be sealingly installed within the tank side wall opening to define a side wall port of the tank. The insert member further has a heat receiving hood portion positionable within the tank and extending axially away from only the upper side portion of the base. In accordance with an aspect of the invention the side port insert member is devoid of structure underlying its top side hood portion.

In addition to the side port insert member, the representatively illustrated temperature sensing system further includes a thermally conductive temperature sensing member, illustratively a metal plate, connected to and projecting outwardly from the base, the temperature sensing member being positionable externally of the tank and having a thermostat coupled thereto and operative to sense its temperature.

In the assembled liquid heating apparatus the tubular insert member base is sealingly placed in the tank side wall opening and forms a port extending through the tank side wall. The heat receiving hood portion extends horizontally from the base inwardly into the tank interior. The elongated electric heating structure is supported by and extends horizontally through the interior of the insert base, with the inactive section of the heating element section being circumscribed by the base, and a top side portion of the active heating element section underlying the hood portion of the insert. The thermostat is controllingly coupled to the electrical heating structure to regulate its operation in response to a thermostat-sensed temperature.

During operation of the liquid heating apparatus, the insert hood portion overlying a top side portion of the active heating element section is heated, with its received heat being conducted outwardly to the thermostat sequentially through the insert base and the externally disposed temperature sensing member. In response to the temperature sensed thereby, the thermostat controls the energization and de-energization of the electric heating structure.

As a representative alternative to the thermostat-based temperature control portion of the liquid heating apparatus, the thermostat and associated temperature sensing member may be replaced by a suitable electronic controller (incorporating therein, for example, a thermistor or thermocouple) thermally coupled to the port insert base and operative to sense its temperature and responsively control the operation of the electric heating structure.

In accordance with a key aspect of the present invention, the positioning of the insert hood over a top side portion of the active heating section of the electrical heating structure provides for rapid sensing of heated liquid temperature within the tank, without substantial controlled temperature "overshoot", during energization of the electrical heating structure. At the same time, the port insert void area disposed beneath its hood portion prevents the premature failure of the heating structure caused by the trapping of scale (falling off the active heating element section) between the active heating element section and a wall portion of the side port insert. Such scale falling off the active element heating section instead simply falls harmlessly to the bottom of the tank.

DETAILED DESCRIPTION

Figure 1:
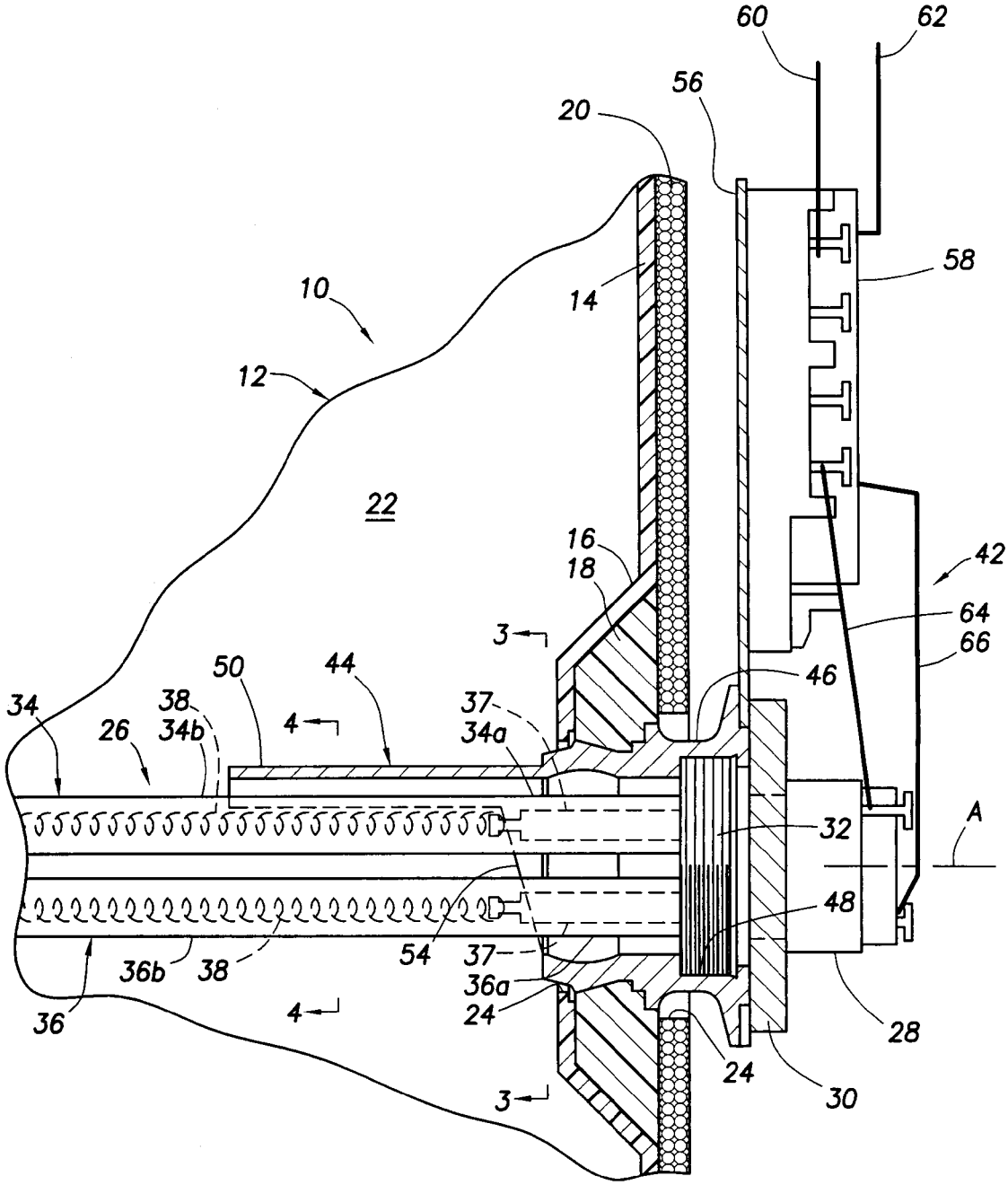
FIG. 1 is a somewhat simplified cross-sectional view through a representative water heater having installed therein a specially designed temperature sensing side port insert embodying principles of the present invention.
Figure 3:
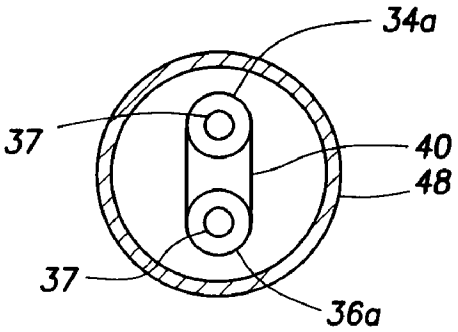
FIG. 3 is a schematic cross-sectional view through the insert, and an associated electric heating element, taken generally along line 3-3 of FIG. 1.

Cross-sectionally depicted in FIG. 1 is a vertical side portion of a liquid heating appliance, representatively an electric water heater 10, embodying principles of the present invention. Illustratively, water heater 10 has a tank portion 12 which is of a filament-wound plastic construction. Tank 12 comprises a blow-molded inner plastic shell 14 (a vertically extending portion of which being shown in FIG. 1) with a horizontally inwardly inset annular well portion 16. Complementarily received within well portion 16 is an annular injection molded insert 18. A resin-impregnated filament winding layer 20 envelopes the shell 14 and extends outwardly around the insert 18 as shown, and functions to externally reinforce the tank against the forces of pressurized heated water 22 stored in the tank 12 for on-demand delivery therefrom in the usual manner to one of more plumbing fixtures communicated with the tank interior via suitable supply piping (not shown) operatively coupled to the tank 12.

Figure 4:
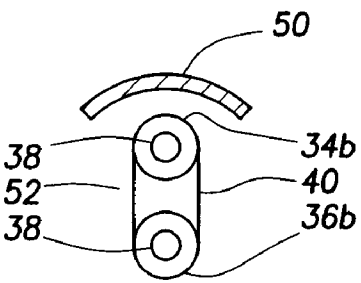
FIG. 4 is a schematic cross-sectional view through the insert and associated electric heating element taken generally along line 4-4 of FIG. 1.

A circularly cross-sectioned side wall opening 24 horizontally extends from the outer surface of the filament winding layer 20, through the insert 18 and shell well 16 into the tank interior. As subsequently described herein, an elongated, conventional resistance type electrical heating structure 26 is supported on a side wall portion of the tank 12 and longitudinally extends into the tank interior through the opening 24. From right to left as viewed in FIG. 1, the electrical heating structure 26 has a cylindrical outer end portion 28, a noncircularly cross-sectioned driving portion 30, an externally threaded cylindrical connection portion 32, and a generally U-shaped submersible electric heating element positioned in the tank water 22 and having horizontally extending upper and lower leg portions 34, 36. Upper and lower leg portions 34, 36 respectively have "cold pin" (i.e., non-heating or inactive) portions 34*a*, 36*a* (with cold pin structures 37 therein) extending inwardly from the threaded connection portion 32, and active heating portions 34*b*, 36*b* extending leftwardly from the cold pin portions 34*a*, 36*a*. Active heating portions 34*b*, 36*b* have coiled electrical resistance wires 38 longitudinally extending through their interiors. As illustrated in FIG. 4, the active heating portions 34*b*, 36*b* are joined at their left or inner ends by a curved heating element section 40.

With reference now to FIGS. 1-4, the present invention the water heater 10 is provided with an improved water temperature sensing system 42 that accurately and rapidly senses, from the outside of the tank 12, the temperature of the water 22 despite the relatively low thermal conductivity of the plastic/filament construction of the tank wall.

According to a key aspect of the present invention the temperature sensing system 42 includes a specially designed port insert member 44 extending along a horizontal axis A and having a tubular axially outer base or outer end portion 46 which circumscribes the axis A and is provided with an internally threaded interior portion 48 (see FIG. 1). The port insert member 44 is representatively formed from a suitable highly heat conductive material such as a metal material, illustratively copper. A top circumferential portion of the tubular base 46 is extended axially inwardly (i.e., to the left as viewed in FIGS. 1 and 2) from the base 46 to form an arcuately cross-sectioned elongated top hood portion 50 of the insert 44 (see FIGS. 1, 2 and 4). This circumferential reduction of the hood 50 relative to the generally tubular base 46 forms in the insert 44 a large bottom void area 52 (see FIG. 2) extending horizontally from the left end of the hood 50 to a downwardly and outwardly sloped interface surface 54 between the hood 50 and base 46. As can be seen in FIG. 1, the interface surface 54 defines an axially inner end surface of the tubular base 46.

With the tank 12 constructed and the opening 24 formed in its vertical side wall portion shown in FIG. 1, the insert 44 is moved, hood end first, inwardly through the insert-defined port 24 to its FIG. 1 position in which the hood 50 is disposed within the tank interior and extends inwardly from a top side portion of the insert base 46. The inserted base 46 is then appropriately sealed to the annular insert 18, as by swaging or by the use of suitable sealing structures (not shown), the base 46 defining in the illustrated tank side wall portion a side wall port opening. With the insert 44 installed, the electrical heating structure 26 is inserted, element end first, through the insert base 46 and threaded into its internally threaded section 48. The insert 44 is longitudinally sized so that its base 46 circumscribes only the inactive cold pin portions 34*a*, 36*a* of the element legs 34 and 36, the insert hood 50 overlies a longitudinally inner top side portion of the upper element leg 34, and no portion of the insert 44 underlies any part of the active portions 34*b*, 36*b* of the element legs 34,36.

In addition to the port insert member 44, the aforementioned temperature sensing system 42 includes a heat conductive sensing plate 56 (representatively formed from a suitable metal such as copper) operatively secured to an external portion of the insert base 46, and a thermostat 58 connected to a side of the plate 56 in heat conductive relationship therewith. Electrical supply power is routed to the thermostat 58 via electrical power leads 60, 62 and electrical control power is supplied to the installed heating structure 26 via electrical control leads 64, 66 operatively interconnected between the thermostat 58 and the outer end portion 28 of the electrical heating structure 26 as shown in FIG. 1.

During operation of the water heater 10 while the active element leg portions 34*b*, 36*b*, are being electrically energized, heat from adjacent water and the active element leg portions 34*b*, 36*b* is received by the port hood 50 and conductively transmitted through the insert base 46 to the exterior sensing plate 56. Sensing plate heat, indicative of the internal tank water temperature, is detected by the thermostat 58 which responsively controls the electric heating structure 26.

In accordance with a key aspect of the present invention, the positioning of the insert hood 50 over a top side portion of the active heating sections 34*b*, 36*b* of the element legs 34, 36 provides for rapid sensing of heated water temperature within the tank, without substantial controlled temperature "overshoot", during energization of the heating structure 26. At the same time, the port insert void area 52 beneath the hood 50 (see FIG. 2) prevents the premature failure of the heating structure 26 caused by the trapping of scale (falling off the active sections 34*b*, 36*b*) between the heating elements and a wall portion of the insert 44. Such scale falling off the active element heating sections 34*b*, 36*b* simply falls harmlessly to the bottom of the tank 12.

While the temperature sensing apparatus of the present invention has been representatively illustrated and described as being incorporated in the tank of a water heater, it will be readily appreciated by those of skill in this particular art that is may be alternatively employed to advantage in a variety of other types of tank-type liquid heating appliances without departing from principles of the present invention.

Figure 5:
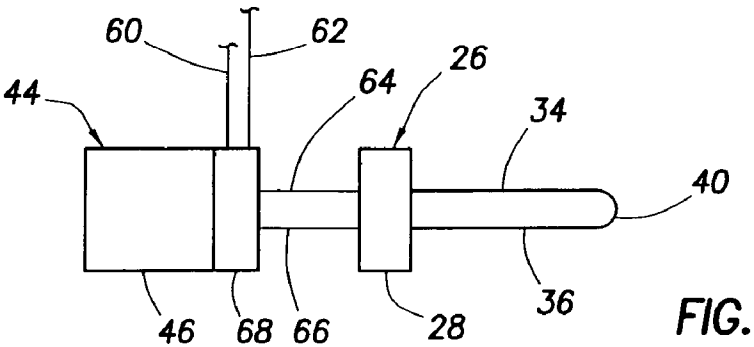
FIG. 5 is a schematic diagram of a representative alternate embodiment of a temperature control portion of the water heater.
Figure 2:
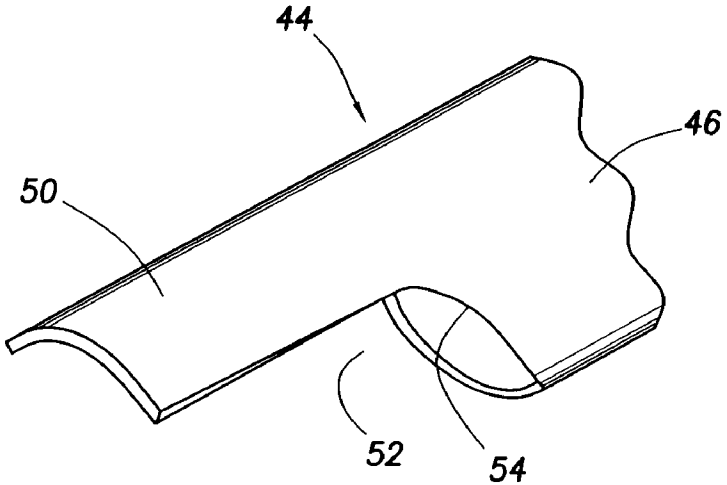
FIG. 2 is a perspective view of an inner end portion of the insert.

Additionally, while the temperature control portion of the liquid heating appliance 10 has been representatively depicted as comprising the thermostat 58 thermally coupled to the port insert member 44 via the sensing plate 56, a variety of other types of temperature control apparatus could be alternately employed, if desired, without departing from principles of the present invention. As but one example, as schematically depicted in FIG. 5, the thermostat 58 and sensing plate 56 could be replaced by a suitable electronic controller 68 (incorporating therein, for example, a thermistor or thermocouple) thermally coupled directly to the portion 46 of the port insert 44 and controllingly coupled to the electric heating structure 26 by the control leads 64, 66. In response to sensing the temperature of the port insert 44, the controller 68 regulates the operation of the electric heating structure 26.

The foregoing detailed description is to be clearly understood as being given by way of illustration and example only, the spirit and scope of the present invention being limited solely by the appended claims.

What is claimed is:

1. For use with a liquid heating appliance having a heated liquid storage tank with an opening in a vertical side wall thereof, temperature sensing apparatus for sensing the temperature of heated liquid within the tank, comprising:

a side port insert member formed from a thermally conductive material and having:

a tubular base circumscribing an axis, said base having an upper side portion and being configured to be sealingly installed within the tank side wall opening to define a side wall port of the tank, and a heat receiving hood portion positionable within the tank and extending axially away from only said upper side portion of said base, said side port insert member being devoid of structure underlying said hood portion, said tubular base being configured to horizontally support an elongated electrical heating structure having an inner end, with only a relatively short outer end portion of the heating structure being circumscribed by the tubular base, and a much longer inner longitudinal portion of the heating structure, including the inner end thereof, horizontally extending through the tank interior from the outer end portion of the heating structure, and said hood portion being configured to overlie only a top side portion of the inner longitudinal portion of the heating structure spaced apart from its inner end.

2. The temperature sensing apparatus of claim 1 wherein:

said side port insert member is formed from a metal material.

3. The temperature sensing apparatus of claim 1 wherein:

said base has an internally threaded portion.

4. The temperature sensing apparatus of claim 1 wherein:

said hood portion has, along its length, a curved, downwardly concave cross-section.

5. The temperature sensing apparatus of claim 1 further comprising:

temperature control apparatus operative to sense the temperature of said insert member.

6. The temperature sensing apparatus of claim 5 wherein:

said temperature sensing apparatus includes a thermally conductive temperature sensing member thermally coupled to and projecting outwardly from said base, said temperature sensing member being positionable externally of said tank, and said temperature control apparatus includes a thermostat mounted on said temperature sensing member and operative to sense the temperature thereof.

7. The temperature sensing apparatus of claim 5 wherein:

said temperature control apparatus includes an electronic temperature controller thermally coupled to said insert member.

8. The temperature sensing apparatus of claim 7 wherein:

said electronic temperature controller is thermally coupled directly to said insert member.

9. Liquid heating apparatus comprising:

a tank for holding liquid to be heated; said tank having a vertical side wall with an opening therein;

a temperature sensing system for externally sensing the temperature of liquid within said tank, said temperature sensing system including a thermally conductive insert member having a tubular base circumscribing a horizontal axis, being sealingly received in said tank sidewall opening and defining a side wall port of said tank, and a heat receiving hood portion disposed within said tank and extending horizontally inwardly away from only a top side wall portion of said base, said insert member being devoid of structure underlying said hood portion; and a heating system operable to heat liquid disposed in said tank, said heating system including an electrical resistance type heating structure secured to and horizontally extending through said base into said tank, said heating structure having an inactive heating element portion circumscribed by said base, and an active heating element portion having an outer portion positioned adjacent said inactive heating element portion and underlying said hood portion of said insert member, and an inner portion extending horizontally inwardly beyond said hood portion.

10. The liquid heating apparatus of claim 9 wherein:

said tank is of a plastic material.

11. The liquid heating apparatus of claim 9 wherein:

said tank is of a filament wound plastic construction.

12. The liquid heating apparatus of claim 9 wherein:

said liquid heating apparatus is a water heater.

13. The liquid heating apparatus of claim 9 wherein said temperature sensing system further includes:

a thermally conductive temperature sensing member disposed externally of said tank and in thermal communication with said base.

14. The liquid heating apparatus of claim 13 wherein:

said temperature sensing member is a metal plate.

15. The liquid heating apparatus of claim 13 wherein said temperature sensing system further includes:

a thermostat mounted on said temperature sensing member in thermal communication therewith and controllingly coupled to said heating structure.

16. The liquid heating apparatus of claim 9 wherein:

said electrical heating structure has an outer end portion threaded into said base.

17. The liquid heating apparatus of claim 9 wherein:

said hood portion, along it length, has a curved, downwardly concave cross-section.

18. The liquid heating apparatus of claim 9 wherein:

said base has a generally circular cross-section along its length.

19. The liquid heating apparatus of claim 9 wherein said temperature sensing system further includes:

temperature control apparatus operative to sense the temperature of said insert member and responsively control the operation of said heating structure.

20. The liquid heating apparatus of claim 19 wherein:

said temperature control apparatus includes a thermostat.

21. The liquid heating apparatus of claim 19 wherein:

said temperature control apparatus includes an electronic controller.

22. The liquid heating apparatus of claim 21 wherein:

said electronic controller is coupled directly to said insert member.

23. The temperature sensing apparatus of claim 1 wherein:

said heat receiving hood portion has an imperforate configuration.

24. The liquid heating apparatus of claim 9 wherein:

said heat receiving hood portion has an imperforate configuration.

* * * * *